US009154895B2

(12) United States Patent
Son et al.

(10) Patent No.: US 9,154,895 B2
(45) Date of Patent: Oct. 6, 2015

(54) APPARATUS OF GENERATING MULTI-CHANNEL SOUND SIGNAL

(75) Inventors: Chang Yong Son, Gunpo-si (KR); Do-Hyung Kim, Hwaseong-si (KR); Kang Eun Lee, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 933 days.

(21) Appl. No.: 12/805,121

(22) Filed: Jul. 13, 2010

(65) Prior Publication Data

US 2011/0116638 A1 May 19, 2011

(30) Foreign Application Priority Data

Nov. 16, 2009 (KR) ..... 10-2009-0110186

(51) Int. Cl.
*H04S 3/00* (2006.01)

(52) U.S. Cl.
CPC ..... *H04S 3/008* (2013.01)

(58) Field of Classification Search
CPC ..... H04S 3/008; H04S 2400/03
USPC ..... 700/94; 381/19–22
See application file for complete search history.

(56) References Cited

U.S. PATENT DOCUMENTS

| | | | | |
|---|---|---|---|---|
| 6,430,528 | B1 | 8/2002 | Jourjine et al. | |
| 7,257,231 | B1 | 8/2007 | Avendano et al. | |
| 7,412,380 | B1 | 8/2008 | Avendano et al. | |
| 7,542,815 | B1 | 6/2009 | Berchin | |
| 2004/0158821 | A1 | 8/2004 | Rickard et al. | |
| 2005/0281408 | A1* | 12/2005 | Kim et al. | 381/17 |
| 2007/0269063 | A1* | 11/2007 | Goodwin et al. | 381/310 |
| 2008/0008327 | A1* | 1/2008 | Ojala et al. | 381/20 |
| 2008/0205676 | A1* | 8/2008 | Merimaa et al. | 381/310 |
| 2008/0247555 | A1* | 10/2008 | Avendano et al. | 381/27 |
| 2009/0060207 | A1 | 3/2009 | Barry et al. | |
| 2009/0080666 | A1 | 3/2009 | Uhle et al. | |

FOREIGN PATENT DOCUMENTS

| | | |
|---|---|---|
| KR | 10-2005-0119605 | 12/2005 |
| KR | 10-2008-0042160 | 5/2008 |

* cited by examiner

*Primary Examiner* — Ping Lee
(74) *Attorney, Agent, or Firm* — Staas & Halsey LLP

(57) ABSTRACT

An apparatus of generating a multi-channel sound signal is provided. The apparatus may include a sound separator to determine a number (N) of sound signals based on at least one of a mixing characteristic and a spatial characteristic of a multi-channel sound signal when receiving the multi-channel sound signal, and to separate the multi-channel sound signal into N sound signals, the sound signals being generated such that the multi-channel sound signal is separated, and a sound synthesizer to synthesize N sound signals to be M sound signals.

11 Claims, 12 Drawing Sheets

APPARATUS OF GENERATING MULTI-CHANNEL SOUND SIGNAL

CROSS-REFERENCE TO RELATED APPLICATIONS

This application claims the benefit of Korean Patent Application No. 10-2009-0110186, filed on Nov. 16, 2009, in the Korean Intellectual Property Office, the disclosure of which is incorporated herein by reference.

BACKGROUND

1. Field

One or more embodiments of the present disclosure relate to a sound signal generation apparatus, and more particularly, to an apparatus of generating a multi-channel sound signal, which may generate audio signals in an output device such as an acoustic information device, etc.

2. Description of the Related Art

A technology of naturally integrating a variety of information such as digital video/audio, computer animation, graphic, and the like has been developed with attempts for increasing a feeling of immersion for a user in fields such as communications, broadcasting services, electric appliances and the like.

As one of various methods of increasing realism of information, a three-dimensional (3D) audio/video apparatus and related signal processing technology has emerged. A 3D audio technology that may accurately reproduce a position of a sound source in an arbitrary 3D space may significantly raise the value of audio content by significantly increasing realism of 3D information included in images or videos or both.

A study for an audio technology to provide a realistic sense of space direction has been made during the past few decades. With an increase in an operation speed of a digital processor, and with significant developments in various sound devices, implementation of the audio technology may be enhanced.

SUMMARY

According to an aspect of one or more embodiments, there may be provided an apparatus of generating a multi-channel sound signal, the apparatus including: a sound separator to determine a number (N) of sound signals based on a mixing characteristic or a spatial characteristic of a multi-channel sound signal when receiving the multi-channel sound signal, and to separate the multi-channel sound signal into N sound signals, the sound signals being generated such that the multi-channel sound signal is separated; and a sound synthesizer to synthesize N sound signals to be M sound signals.

In this instance, N may vary over time.

Also, the sound separator may include: a panning coefficient extractor to extract a panning coefficient from the multi-channel sound signal, and a prominent panning coefficient estimator to extract a prominent panning coefficient from the extracted panning coefficient using an energy histogram, and to determine a number of the prominent panning coefficients as N.

Also, the sound synthesizer may include a binaural synthesizer to generate M sound signals using a Head Related Transfer Function (HRTF) measured in a predetermined position.

According to another aspect of one or more embodiments, there may be provided an apparatus of generating a multi-channel sound signal, the apparatus including: a primary-ambience separator to separate a source sound signal into a primary signal and an ambience signal; a channel estimator to determine a number (N) of sound signals based on the source sound signal, the sound signals being generated such that the primary signal is separated; a source separator to separate the primary signal into N sound signals; and a sound synthesizer to synthesize N sound signals to be M sound signals, and to synthesize at least one of M sound signals and the ambience signal.

In this instance, N may be determined depending on a number of sources mixed in the source sound signal.

Also, the channel estimator may include: a panning coefficient extractor to extract a panning coefficient from the source sound signal, and a prominent panning coefficient estimator to extract a prominent panning coefficient from the extracted panning coefficient using an energy histogram, and to determine a number of the prominent panning coefficients as N.

According to still another aspect of one or more embodiments, there may be provided an apparatus of generating a multi-channel sound signal, the apparatus including: a sound separator to separate a multi-channel sound signal into N sound signals using position information of a source signal mixed in the multi-channel sound signal when receiving the multi-channel signal; and a sound synthesizer to synthesize N sound signals to be M sound signals.

In this instance, the sound separator may determine a number (N) of the sound signals using the position information of the source signal mixed in the multi-channel sound signal, the sound signals being generated such that the multi-channel sound signal is separated.

Also, the position information of the source signal mixed in the multi-channel sound signal may be a panning coefficient extracted from the multi-channel sound signal.

Also, the sound separator may include: a panning coefficient extractor to extract a panning coefficient from the multi-channel sound signal, and a prominent panning coefficient estimator to extract a prominent panning coefficient from the extracted panning coefficient using an energy histogram, and to determine a number of the prominent panning coefficients as N.

According to a further aspect of one or more embodiments, there may be provided an apparatus of generating a multi-channel sound signal, the apparatus including: a primary-ambience separator to generate, from a left surround signal (SL) and a right surround signal (SR) of a 5.1 surround sound, a left primary signal (PL), a right primary signal (PR), a left ambience signal (AL), and a right ambience signal (AR); a channel estimator to determine a number (N) of sound signals being generated from the left primary signal (PL) and the right primary signal (PR); a source separator to receive the left primary signal (PL) and the right primary signal (PR) and to generate the received signals as N sound signals; and a sound synthesizer to synthesize N sound signals to generate a left back signal (BL) and a right back signal (BR), to synthesize the left back signal (BL) and the left ambience signal (AL), and to synthesize the right back signal (BR) and the right ambience signal (AR).

In this instance, the channel estimator may determine N based on a mixing characteristic or a spatial characteristic of the left surround signal (SL) and the right surround signal (SR).

Also, the channel estimator may include: a panning coefficient extractor to extract a panning coefficient from the left surround signal (SL) and the right surround signal (SR); and a prominent panning coefficient estimator to extract a prominent panning coefficient from the extracted panning coefficient, and to determine a number of the prominent panning coefficients as N.

Additional aspects, features, and/or advantages of exemplary embodiments will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the exemplary embodiments, taken in conjunction with the accompanying drawings of which.

DETAILED DESCRIPTION

Figure 1:
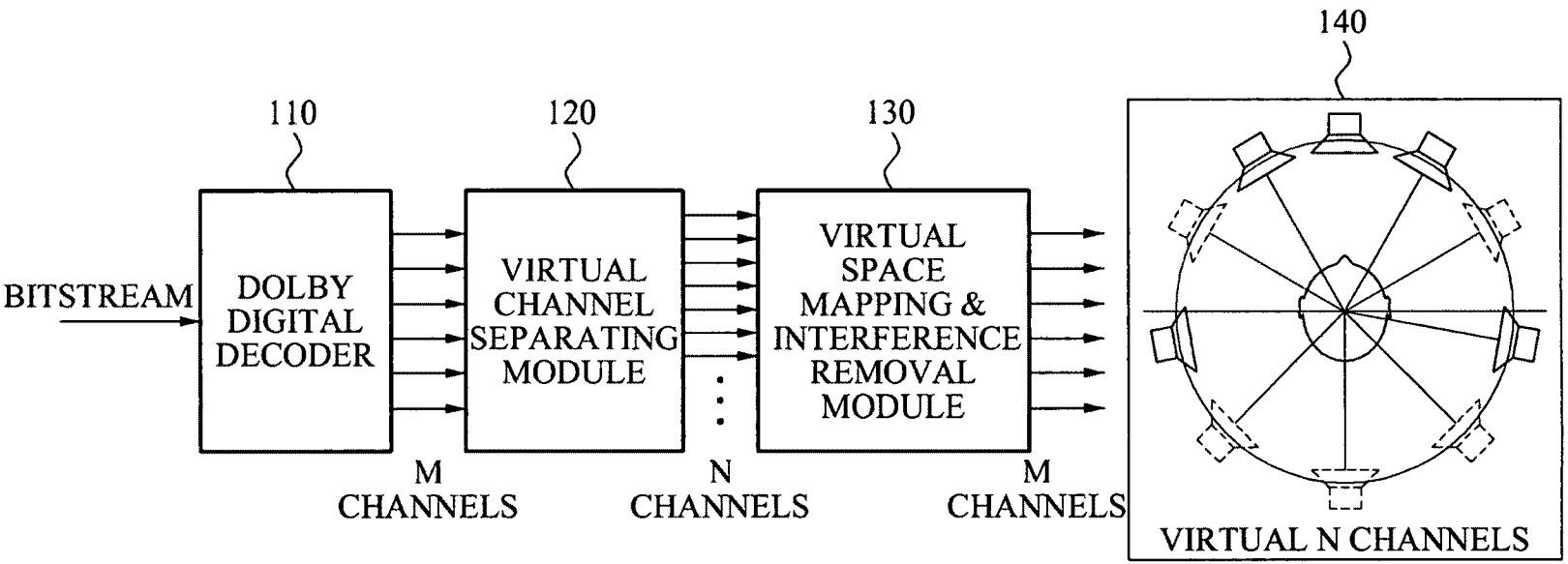
FIG. 1 is a diagram illustrating a configuration of a method of playing a multi-channel sound in an apparatus of generating a multi-channel sound signal according to an embodiment.

Reference will now be made in detail to exemplary embodiments, examples of which are illustrated in the accompanying drawings, wherein like reference numerals refer to the like elements throughout. Exemplary embodiments are described below to explain the present disclosure by referring to the figures.

FIG. 1 is a diagram illustrating a configuration of a method of playing a multi-channel sound in an apparatus 100 (e.g., an apparatus of generating a multi-channel sound signal) according to an embodiment.

The apparatus 100 according to an embodiment may be an apparatus of playing a multi-channel sound with improved realism and three-dimensional (3D) feeling using a system having a relatively small number of speakers.

In particular, a 3D effect of a multi-channel sound may be obtained even though a sound is played only using the small number of speaker systems by combining a virtual channel separation technology, and a virtual channel mapping technology of generating a virtual speaker to enable a sound to be localized in a limited speaker system environment. In this instance, the virtual channel separation technology may be performed such that a number of output speakers increases by separating/expanding, into a number of audio channels where an actual sound exists, a number of audio channels obtained by mixing or recording a sound using a limited number of microphones in a process of generating audio contents, thereby improving a 3D effect and realism.

The apparatus 100 according to an embodiment may include a virtual channel separation process of separating/expanding sound sources into virtual channels based on inter-channel mixing characteristics of multi-channel sound sources obtained by decoding a multi-channel encoded bit stream, and a process of enabling variable channel sounds, having been virtual channel separated, to be accurately localized in a virtual speaker space to play the variable channel sounds using the small number of speakers.

Referring to FIG. 1, the apparatus 100 according to an embodiment may decode the multi-channel encoding bit stream into M channels using a digital decoder 110, and separate the decoded M channels into N channels based on inter-channel mixing and spatial characteristics, using a virtual channel separating module 120.

Here, the virtual channel separating module 120 may separate or expand, into a number of audio channels where an actual sound exists, a number of audio channels obtained by mixing or recording a sound using a limited number of microphones in a process of generating audio contents.

To perform the channel separation process based on the inter-channel mixing/spatial characteristics, the virtual channel separation module 120 may extract an inter-channel panning coefficient in a frequency domain, and separate a sound source using a weighting filter where the extracted panning coefficient is used.

The separated sound source may be re-synthesized into the same number of channel signals as that of actual output speakers.

In this instance, the virtual channel separating module 120 may perform separating using a virtual channel separation method having an improved de-correlation between separated signals. In this instance, a distance from a sensed sound source and a width of the sound may be inversely proportional to a degree of correlation between the separated signals.

A sound signal separated into N channels by the virtual channel separating module 120 may again be mapped into M channels using a virtual space mapping & interference removal module 130, and may consequentially generate N virtual channel sounds using a speaker system 140.

In the virtual space mapping & interference removal module 130, the virtual space mapping may generate a virtual speaker in a desired spatial position in a limited number of speaker systems to thereby enable a sound to be localized.

As an example of the virtual space mapping, a case where a virtual sound source is generated based on a Head-Related Transfer Function (HRTF) with respect to left back/right back signals of a 5.1 channel speaker system to remove a cross-talk, and a 7.1 channel audio signal is generated by synthesizing the generated virtual sound source and left/right surround signals is described herein below in more detail.

Also, the apparatus according to an embodiment may adaptively separate sound sources into a various number of channels of sound sources based on inter-channel mixing/spatial characteristics of multi-channel sound sources, and may unify, into a single process, a down-mixing process used in the virtual channel separation process and the virtual channel mapping process, and thereby may eliminate a cause of degrading a sound localization characteristics due to an increased interference between identical sound sources.

In addition, the apparatus according to an embodiment may determine a number of sound channels intended to be separated, by predicting a number of mixed sound sources using a method of chronologically obtaining characteristics between target sound sources to be channel-separated, and separate sound sources into a variable channel number per processing unit, using the determined number of sound channels.

The sound channel separated in the virtual channel separating module 120 may perform a down-mixing process and an interference canceling process, without performing a re-synthesizing process that may reduce the degree of de-correlation between channels due to a limitation in a number of output speakers, thereby generating the multi-channel sound signals. As a result, realism and a 3D effect of the multi-channel sound may be obtained even when a sound is played using a system having only a relatively small number of speakers.

Figure 2:
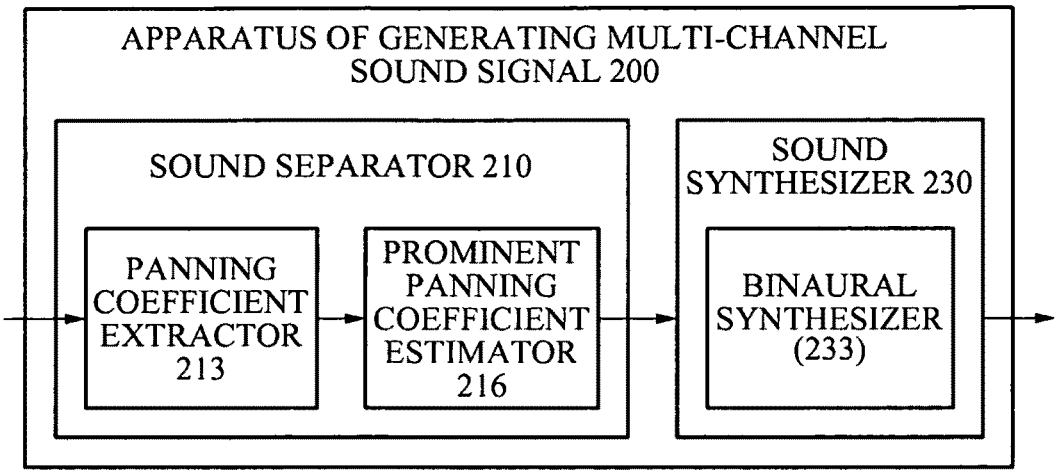
FIG. 2 is a block diagram illustrating an apparatus 200 of generating a multi-channel sound signal according to another embodiment.

FIG. 2 is a block diagram illustrating an apparatus 200 of generating a multi-channel sound signal according to another embodiment.

Referring to FIG. 2, the apparatus 200 according to an embodiment may include a sound separator 210 and a sound synthesizer 230.

The sound separator 210 may determine a number (N) of sound signals based on a mixing characteristic or a spatial characteristic of a multi-channel sound signal when receiving the multi-channel sound signal, and separate the multi-channel sound signal into N sound signals. In this instance, the sound signals may be generated such that the multi-channel sound signal is separated. Here, the mixing characteristic may designate an environmental characteristic where the multi-channel sound is mixed, and the spatial characteristic may designate a spatial characteristic where the multi-channel sound signal is recorded, such as arrangement of microphones.

When received sound signals are recorded into three channels, the sound separator 210 according to an embodiment may determine a number of sound sources that the received three-channel sound signals are obtained from.

That is, when it is assumed that sound signals are recorded using five microphones, the multi-channel sound separator 210 may determine, as '5', the number (N) of sound signals to be generated, based on the spatial characteristic or the mixing characteristic concerning a number of sound sources (e.g., a number of microphones) with respect to the sound signals are arranged and recorded in a recorded space, and may separate the received three channel-sound signals into five channel-sound signals.

In this instance, the number (N) of sound signals to be separated in the apparatus 200 may vary over time, or may be arbitrarily determined by a user.

By way of three processes, that is, a process of extracting a panning coefficient between channels in a frequency domain, a process of separating sound sources by utilizing a weighting filter using an extracted panning coefficient, and a re-panning process used for synthesizing sound signals in a predetermined speaker position, a same number of channel sound signals as a number of actual output speakers may be played. In this instance, the process of extracting the panning coefficient between channels may be performed such that audio sound channels obtained by mixing sounds or using a limited number of microphones when generating audio contents are separated/expanded to have a number of audio sound channels where actual sounds exist to thereby increase a number of output speakers, thereby improving realism and a 3D effect.

When sounds are re-synthesized based on a number of target actual speakers after separating the sounds in the virtual channel separating process, or the sounds are separated to have a same number of channel sound signals as a number of actual output speakers, separated sound channel signals may be synthesized and played to have the same number of channel sound signals as the number of actual output speakers based on positions of the real output speakers, while the re-panning process is performed (an amplitude-pan scheme of implementing a direction feeling when playing the sounds by inserting a single sound source into both sides of channels to have different magnitudes of the sound source).

A degree of de-correlation of sound channel sources separated in this process may be reduced, and interferences between identical sound sources increase when the sound channel sources are played through the down-mixing scheme by mapping a virtual space, and thereby a sound localization characteristic may be deteriorated.

Figure 3A:
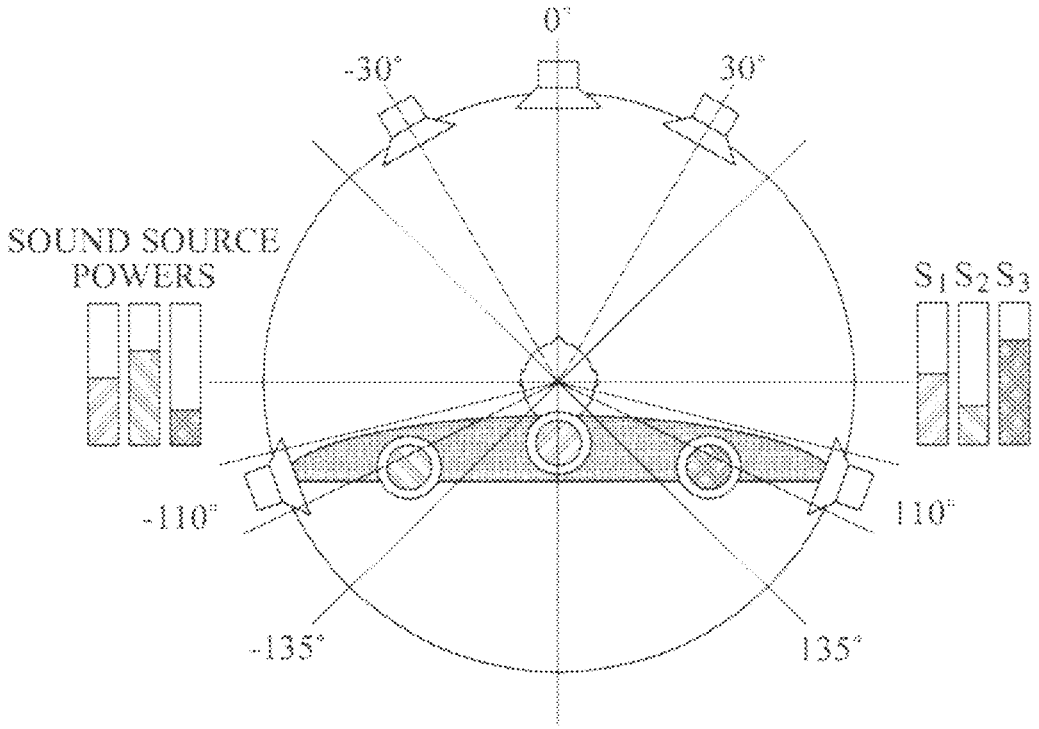
FIGS. 3A and 3B are diagrams illustrating a sense of space which an actual audience feels by a generated sound when 5.1 channel audio contents are generated in a 5.1 channel speaker system and a 7.1 channel speaker system, respectively, in an apparatus of generating a multi-channel sound signal according to an embodiment.
Figure 3B:
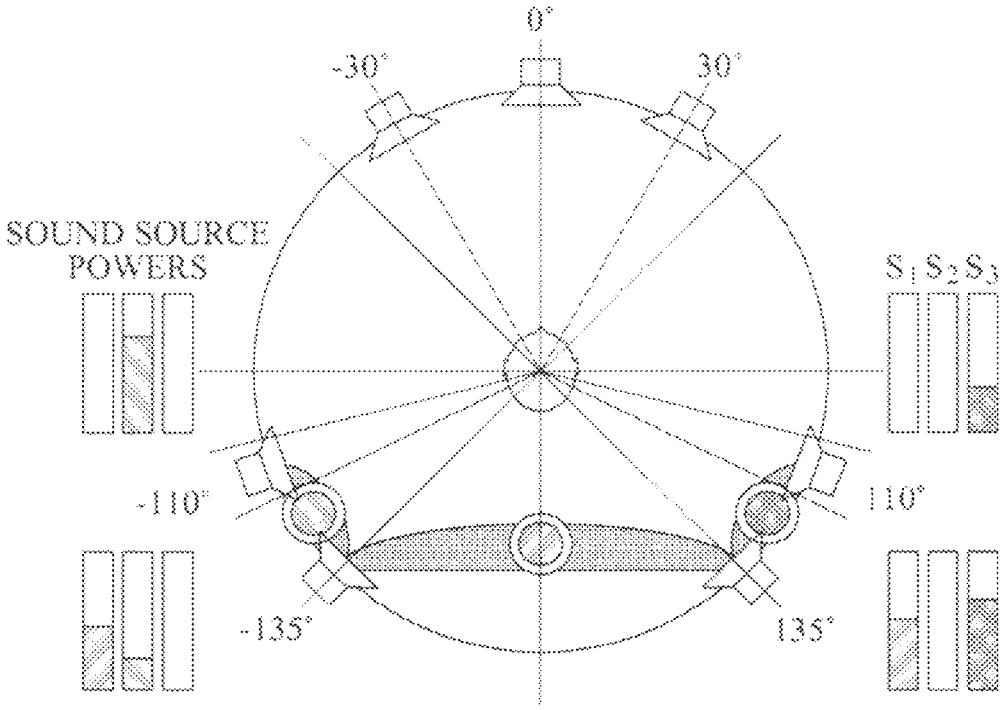

FIGS. 3A and 3B are diagrams illustrating a sense of space which an actual audience feels by a generated sound when 5.1 channel audio contents are generated in a 5.1 channel speaker system and a 7.1 channel speaker system, respectively, in an apparatus of generating a multi-channel sound signal according to an embodiment.

As illustrated in FIG. 3A, there may be shown the sense of space which the real audience feels when playing a sound comprised of left/right surround channel signals where three sound sources are mixed by way of amplitude panning when playing the 5.1 channel audio contents in the 5.1 channel speaker system is played.

Alternatively, as illustrated in FIG. 3B, the apparatus according to an embodiment may perform a re-synthesizing process in which the 5.1 channel audio contents are separated into three sound sources from left/right surround channel signals, and a 3D effect is improved while maintaining a direction feeling of a sound source in the predetermined 7.1 channel speaker.

In this case, through separating/expanding of the virtual channel, a 7.1 channel sound having a more improved 3D effect and realism in comparison with an existing 5.1 channel speaker system may be provided to audiences.

When mapping separated sound sources in a determined number of speakers after separating the sound source in the virtual channel separator 210, sound sources may be inserted into both sides of channel speakers to have different magnitudes of the sound sources in a process of re-synthesizing sounds while maintaining a direction feeling of mixed sound signals, and thereby may cause a phenomenon in which a degree of correlation between a surround channel signal and a back-surround channel signal increases.

Here, a degree of correlation between output channel signals may be a performance indicator with respect to separating a virtual channel.

As a method of measuring the degree of correlation, a coherence function defined in a frequency domain may be a convenient measurement tool of measuring the degree of correlation for each frequency. A coherence function $\gamma(\omega)$ of two digital sequences may be defined as in the following Equation 1.

$$\gamma_{ij}(\omega) = \frac{S_{x_i x_j}(\omega)}{\sqrt{S_{x_i x_j}(\omega) S_{x_j x_i}(\omega)}}, \quad \text{[Equation 1]}$$

where $S_{x_i x_j}(\omega)$ represents an auto spectrum obtained by Fourier-transforming a correlation function of $x_i(n)$ and $x_j(n)$, that is, two digital sequences.

As for a width of an auditory event, an increase from '1' to '3' may be shown when an Inter-Channel Coherence (ICC) between left/right source signals is reduced.

Accordingly, the ICC may be an objective measurement method of measuring a width of a sound. In this instance, the ICC may have a value ranging from zero to '1'.

A method of measuring a degree of correlation between multi-channel audio output signals in a time domain may be performed by calculating a cross correlation function as shown in the following Equation 2.

$$\Omega(\Delta t) = \lim_{t \to \infty} \frac{1}{2T} \int_{-T}^{T} y_1(t) y_2(t + \Delta t), dt, \quad \text{[Equation 2]}$$

where $y_1$ and $y_2$ respectively represent an output signal, and $\Delta t$ represents a temporal offset of two signals of $y_1$ (t) and $y_2$ (t).

Measuring of a degree of correlation may be determined using a single number (lag 0) having a largest absolute value from among cross correlation values varying according to a change in the temporal offset.

In general, the degree of correlation may be at a peak value when the temporal offset (lag value) is zero, however, the measuring of the degree of correlation may be performed by applying the temporal offset with respect to a range of 10 ms to 20 ms to determine whether to have inter-channel delayed signal characteristics.

The measuring of the degree of correlation may cause timbre coloration due to a 'comb filter' effect that may reduce/increase frequency components having a frequency-periodic pattern in 20 ms or more due to a first early reflection after arrival of direct sounds, thereby reducing a sound performance.

The degree of correlation may have a value ranging from '−1' to '+1'. For example, '+1' may designate two identical sound signals, and '−1' may designate two identical signals of which phases are distorted by 180 degrees. When the degree of correlation significantly approaches zero, it may be determined as highly uncorrelated signals.

As for a distance from a sound source and a width of sound sensed depending on a degree of correlation between loudspeaker channels, the width of sound may be proportional to the degree of correlation, and a distance feeling from the sound source may be reduced as the degree of correlation changes from '1' to '−1'.

The apparatus according to an embodiment may have a structure of increasing a degree of de-correlation between channel signals having been virtual channel separated.

The sound separator 210 may extract a prominent panning coefficient from an extracted panning coefficient using a panning coefficient extractor 213 of extracting a panning coefficient from a multi-channel sound signal and also using an energy histogram, and may include a prominent panning coefficient estimator 216 of determining a number of prominent panning coefficients as N.

A method of extracting a panning coefficient in the panning coefficient extractor 213 and a method of determining a prominent panning coefficient in the prominent panning coefficient estimator 216 will be described using the Equations below.

In general, a mixing method used in creating a multi-channel stereo sound signal may be performed using an amplitude-pan scheme of implementing a direction feeling when playing a sound by inserting a single sound source into both sides of channels to have different magnitudes of the sound source.

A method of extracting separated sound sources before sound signals are mixed from the multi-channel sound signals may be referred to as an up-mixing scheme (or un-mixing), and a major processing of the up-mixing scheme may be performed in a time-frequency domain based on a W-disjoint orthogonal assumption, that is, an assumption in which separated sound sources before the sound signals are mixed are not overlapped in all time-frequency domains.

The up-mixing scheme may be used to generate backward surround signals.

When N sound sources are mixed in stereo, a signal model as shown in the following Equation 3 may be obtained.

$$x_1(t) = \sum_{j=1}^{N} \alpha_j s_j(t) + n_1(t) \quad \text{[Equation 3]}$$

$$x_2(t) = \sum_{j=1}^{N} (1 - \alpha_j) s_j(t - \delta_j) + n_2(t),$$

where $s_j(t)$ represents an original signal, $x_1(t)$ represents a mixed signal of a channel of a left-hand side, $x_2(t)$ represents a mixed signal of a channel of a right-hand side, $\alpha_j$ represents a panning coefficient indicating a degree of being panned, $\delta_j$ represents a delay coefficient indicating a degree in which a right handed channel is delayed in comparison with a left handed channel, and $n_1(t)$ and $n_2(t)$ respectively represent a noise inserted in respective channels.

The signal model shown in Equation 3 may be a model obtained based on a delay between both left/right channels, and when up-mixing target signals are limited to studio mixed sound signals in an amplitude-panning scheme in order to simplify the signal model, the delay coefficient and noise may be ignored, and a simple signal model as shown in the following Equation 4 may be obtained.

$$x_1(t) = \sum_{j=1}^{N} \alpha_j s_j(t) \quad \text{[Equation 4]}$$

$$x_2(t) = \sum_{j=1}^{N} (1 - \alpha_j) s_j(t).$$

To obtain the panning coefficient indicating a degree in which separated sound sources are panned, the following Equation 5 may be obtained when Fourier-transformation is performed on the signal model.

$$X_1(\omega) = \sum_{j=1}^{N} \alpha_j S_j(\omega) \quad \text{[Equation 5]}$$

-continued $$X_2(\omega) = \sum_{j=1}^{N} (1 - \alpha_j) S_j(\omega).$$

$X_1(\omega_0)$ and $X_2(\omega_0)$ in a specific frequency $\omega_0$ may be represented as in the following Equation 6.

$$X_1(\omega_0) = \alpha_j S_j(\omega_0)$$

$$X_2(\omega_0) = (1-\alpha_j) S_j(\omega_0) \quad \text{[Equation 6]}$$

In this instance, when dividing both sides of $X_1(\omega_0)$ and $X_2(\omega_0)$ by $\alpha_j$, the following Equation 7 may be obtained.

$$\alpha_j = \frac{|X_1(\omega_0)|}{|X_1(\omega_0)| + |X_2(\omega_0)|}. \quad \text{[Equation 7]}$$

Using Equation 7, a panning coefficient in all ω and t may be obtained.

When the above described W-disjoint orthogonal assumption is correct, the panning coefficients in all time-frequency domains may need to be made up of panning coefficients used when mixing sound sources. However, the W-disjoint orthogonal assumption may not be practically correct because actual sound sources do not satisfy the assumption.

However, these problems may be overcome by the prominent panning coefficient estimator 216 of extracting a prominent panning coefficient from an extracted panning coefficient using the energy histogram, and determining a number of prominent coefficients as N.

When energies of respective panning coefficients are added up to obtain an energy histogram after obtaining panning coefficients of all frequencies in respective time frames, a region where the energies are dense may be determined as a region where a sound source exists.

Figure 4:
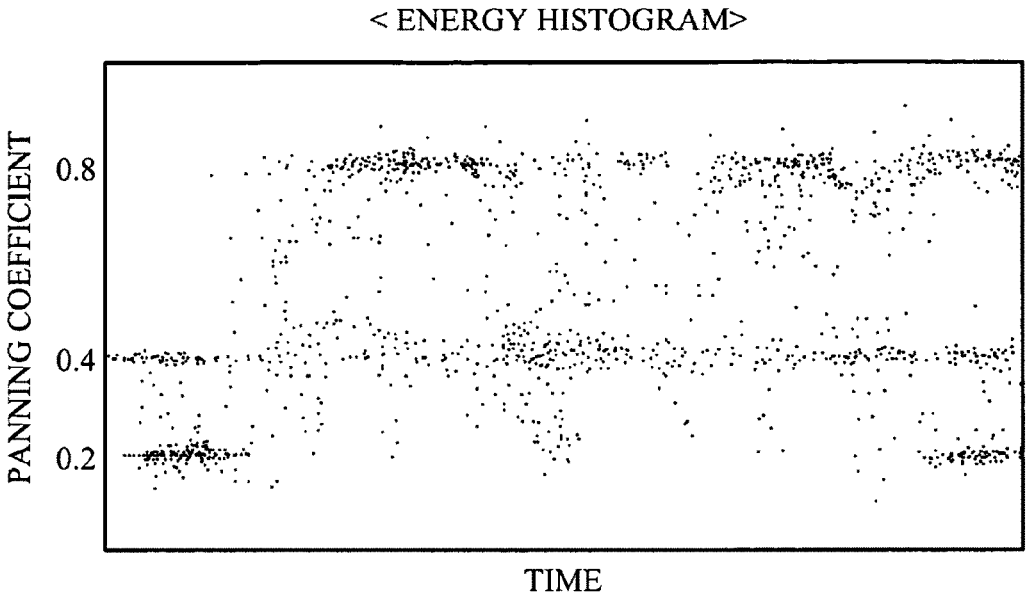
FIG. 4 is a diagram illustrating a test result of an energy histogram in an apparatus of generating a multi-channel sound signal according to an embodiment.

FIG. 4 is a diagram illustrating a test result of an energy histogram in an apparatus of generating a multi-channel sound signal according to an embodiment.

In the energy histogram, a white portion may indicate a place where energy is high. As shown in FIG. 4, the energy is high at 0.2, 0.4, and 0.8 of the energy histogram for five seconds.

Here, taking a phase change into account, a degree in which energies are dense in a corresponding panning coefficient may increase. This may be based on a fact that a phase difference between both channels is reduced when an interference between sound sources is insignificant, and the phase difference is increased when the interference is significant.

Through the above described processes, a number of sound source signals being mixed and respective panning coefficients may be obtained.

After obtaining the number of sound sources and the panning coefficients, a method of extracting, from the mixed signals, a sound source signal being panned in a specific direction may be performed as below.

A signal may be created in a time-frequency domain by multiplying all time frames by a weight factor value corresponding to a panning coefficient (α) of respective frequencies, and an inverse-Fourier transformation may be performed on the created signal to move the created signal into an original time domain, and thereby a desired sound source may be extracted as shown in the following Equation 8.

$$W(\alpha) = v + (1 - v)e^{-\frac{1}{2\varepsilon}(\alpha-\alpha_0)^2}. \quad \text{[Equation 8]}$$

where $$\begin{cases} v\text{: floor value} \\ \varepsilon\text{: factor of adjusting a width of window} \\ \alpha_0\text{: desired panning coefficient} \end{cases}$$

A criterion of separating channel signals using the panning coefficient for each frame signal in the apparatus according to an embodiment may be realized using a current panning coefficient (α) of Equation 8, and a desired panning coefficient ($\alpha_0$) may be a prominent panning coefficient obtained from the prominent panning coefficient estimator 216.

The prominent panning coefficient estimator 216 may obtain an energy histogram of the current panning coefficients, and determine a number (N) of channels intended to be separated using the obtained energy histogram. The number (N) of channels and the prominent panning coefficient obtained in the prominent panning coefficient estimator 216 may be used in separating signals based on a degree in which a current input signal is panned together with the current panning coefficient.

Here, the weight factor may use a Gaussian window. To avoid problems such as an error and a distortion occurring when extracting a specific sound source, a smoothly reducing-type window with respect to the desired panning coefficient may be used, and for example, a Gaussian-type window of adjusting a width of a window may be used.

When the width of the window increases, the sound sources may be smoothly extracted, however other undesired sound sources may accordingly be extracted. When the width of the window is reduced, desired sound sources may be mainly extracted, however, the extracted sound sources may not be smooth sounds and may include noise. A reference value v may be used to prevent an occurrence of noise due to a reference value v of zero in the time-frequency domain.

The up-mixing scheme of extracting respective sound sources from a multi-channel signal where an amplitude panning is operated may more effectively extract the sound sources using a weight factor being linear-interpolated based on the panning coefficient.

However, since the amplitude-panned sound sources are limited as targets of the up-mixing scheme, the up-mixing scheme may need to improve the up-mixing scheme based on a delay time between channels generated in an actual environment different from a studio.

The apparatus according to an embodiment may improve realism with respect to backward surround sound and a performance with respect to a wide spatial image, through processing an ambience signal with respect to realism and a 3D effect.

The sound synthesizer 230 may synthesize N sound signals to be M sound signals. The sound synthesizer 230 may synthesize N sound signals generated using a prominent panning coefficient determined by an energy histogram in the prominent panning coefficient estimator 216, as illustrated in FIG. 4, from among a panning coefficient extracted in the sound separator 210 and the extracted panning coefficient, to be M sound signals being suitable for the speaker system.

Also, the sound synthesizer 230 may include a binaural synthesizer 233 of generating M sound signals using an HRTF measured in a predetermined position.

The binaural synthesizer 233 may function to mix multi-channel audio signals into two channels while maintaining a direction feeling. In general, a binaural sound may be generated using the HRFT having information for recognizing a stereo directional feeling with two human ears.

The binaural sound may be a scheme of playing sounds using a speaker or a headphone via two channels, based on a fact that humans can determine a direction of origin of sounds by merely using two ears. In this instance, as a major factor of the binaural sound, an HRTF between a virtual sound source and two ears may be given.

Because of the HRTF including information about a location of sounds, humans can determine the direction of an origin of sounds in a 3D space using only two ears.

The HRTF may be obtained such that sounds from speakers disposed at various angles using a dummy head are recorded in an anechoic chamber, and the recorded sounds are Fourier-transformed. In this instance, since the HRTF varies according to a direction of an origin of sounds, corresponding HRTFs may be measured with respect to sounds from various locations, and the measured HRTFs are constructed in a database to be used.

As direction factors that most simply and representatively designate the HRTF, an Inter-aural Intensity Difference (IID), that is, a level difference in sounds reaching two ears, and an Inter-aural Time Difference (ITD), that is, a temporal difference in sounds reaching two ears may be given, and IID and ITD may be stored for each frequency and for a 3D direction.

Using the above described HRTF, binaural sounds of two channels may be generated, and the generated binaural sounds may be outputted using a headphone or a speaker via a digital/analog conversion. When playing sounds using the speaker, a crosstalk elimination scheme may be needed. Accordingly, left/right speakers may seem to be positioned near two ears even though the positions of the left/right speakers are not actually changed, which may have nearly the same effect as that obtained when playing sounds using an earphone.

As for the sound synthesizer 230, when a number of real sound sources is seven, sound signals inputted via three channels are separated into seven, and the separated seven sound signals are synthesized, using the sound synthesizer 230, to be five channel-sound signals being suitable for an actual speaker system.

As a method of synthesizing sounds in the sound synthesizer 230, a case where sounds encoded into a 7.1 channel system are played using a 5.1 channel speaker system may be given.

Here, the 5.1 channel may designate six channels of a left (L) channel, a right (R) channel, and a center (C) channel, which are disposed frontward, and a left surround (SL) channel, a right surround (SR) channel, and a low frequency effect (LFE) channel, which are disposed rearwards. In this instance, the LFE channel may play frequency signals of 0 Hz to 120 Hz.

In contrast, the 7.1 channel may designate eight channels of the above described six channels and two additional channels, that is, a left back (BL) channel, and a right back (BR) channel.

The sound synthesizer 230 according to an embodiment will be further described with reference to FIG. 5.

Figure 5:
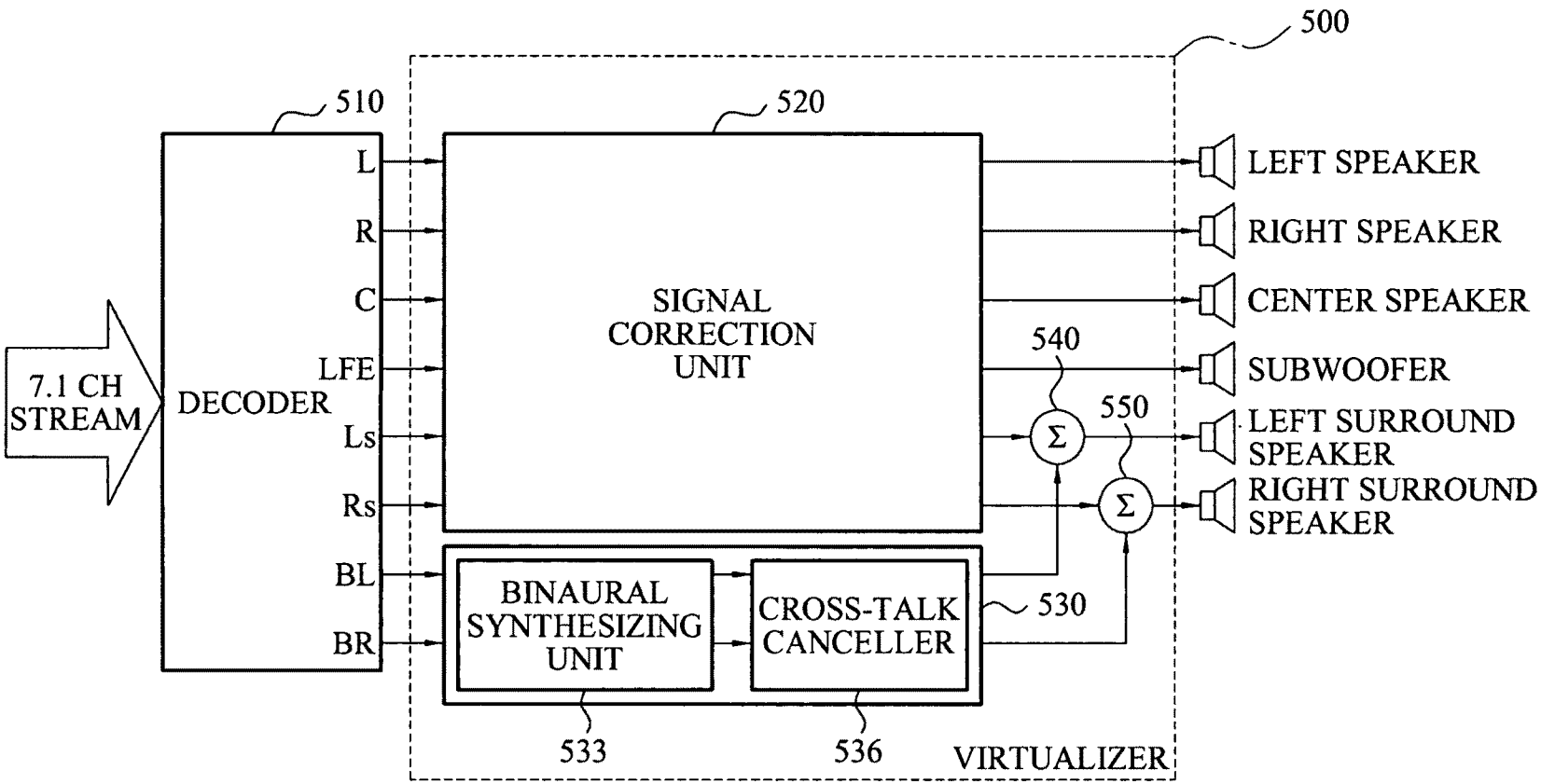
FIG. 5 is a block diagram illustrating a sound synthesizer according to an embodiment.

FIG. 5 is a block diagram illustrating a sound synthesizer according to an embodiment.

The sound synthesizer includes a virtual signal processing unit 500, a decoder 510, and six speakers. The virtual signal processing unit 500 includes a signal correction unit 520, and a back-surround filter 530. The back-surround filter 530 includes a binaural synthesizing unit 533 and a crosstalk canceller 536.

The left (L) channel, the right (R) channel, the center (C) channel, the left surround (SL) channel, the right surround (SR) channel, the low frequency effect (LFE) channel of the 7.1 channel may be played using the 5.1 channel speaker corresponding to the 7.1 channel by correcting a time delay and an output level. Further, sound signals of the left back (BL) channel and the right back (BR) channel may be filtered through a back-surround filter matrix, and the filtered sound signals may be played using a left surround speaker and a right surround speaker.

Referring to FIG. 5, the decoder 510 may separate audio bit streams of the 7.1 channel inputted from a Digital Video Disk (DVD) regenerator into eight channels, that is, the left (L) channel, the right (R) channel, the center (C) channel, the left surround (SL) channel, the right surround (SR) channel, the low frequency effect (LFE) channel, the left back (BL) channel, and the right back (BR) channel.

The back-surround filter 530 may generate a virtual left back speaker and a virtual right back speaker, with respect to the left back (BL) channel and the right back (BR) channel outputted from the decoder 510.

The back-surround filter 530 may include the binaural synthesizing unit 533 and the crosstalk canceller 536 to generate a virtual sound source with respect to a position of the back surround speaker and with respect to signals of the left back channel and the right back channel, based on an HRTF measured in a predetermined position, and to cancel a crosstalk of the virtual sound source.

Also, a convolution may be performed on a binaural synthesis matrix and a crosstalk canceller matrix to generate a back-surround filter matrix K(z).

The signal correction unit 520 may correct the time delay and the output level with respect to the left (L) channel, the right (R) channel, the center (C) channel, the left surround channel, the right surround channel, and the low frequency effect (LFE) channel.

When sound signals of the back left channel and the back right channel from among the inputted 7.1 channel sound signals pass through a back surround filter matrix to be played using a left surround speaker and a right surround speaker, and when 5.1 channel sound signals other than the 7.1 channel sound signals are played as are, using a 5.1 channel speaker system, unnatural sounds may be played due to a time delay and an output level difference occurring between the sound signals passed through the back surround filter matrix and the 5.1 channel sound signals.

Accordingly, the signal correction unit 520 may correct the time delay and the output level with respect to the 5.1 channel sound signals based on characteristics of the back surround filter matrix of the back surround filter 530.

Also, since the characteristics of the back surround filter matrix are corrected, the signal correction unit 520 may correct the time delay and the output level in the same manner with respect to all channels of the 5.1 sound signals, which is different for each channel of the 5.1 channel sound signals. That is, a filter matrix G(z) may be convoluted with respect to each channel sound signal. The filter matrix G(z) with respect to the time delay and the output level may be designed as in the following Equation 9.

$$G(z)=az-b, \quad \text{[Equation 9]}$$

where 'a' represents an output signal level-related value, which is determined by comparing Root Mean Square (RMS) powers of input/output signals of the back surround filter matrix, and 'b' represents a time delay value of the back surround filter matrix, which is obtained through an impulse response of the back surround filter matrix, phase characteristics, or an aural comprehension examination.

A first addition unit 540 and a second addition unit 550 may add the sound signals of the left/right surround channels generated in the signal correction unit 520 and the sound signals of the virtual left/right back channels generated in the back surround filter unit 530.

That is, the 7.1 channel sound signals may pass through the filter matrix G(z) for the signal correction unit 520 and the filter matrix K(z) for the back surround filter 530 to be down-mixed as the 5.1 channel sound signals. Sound signals of the left (L) channel, the right (R) channel, the center (C) channel, and the low frequency effect (LFE) channel may pass through the filter matrix G(z) for the signal correction unit 520 to be played using the left speaker, the right speaker, the center speaker, and a sub-woofer.

Sound signals of the left surround (SL) channel and the right surround (SR) channel may pass through the filter matrix G(z) for the signal correction unit 520 to be played as left/right output signals. Sound signals of the left back (BL) channel and the right back (BR) channel may pass through the filter matrix K(z) for the back surround filter 530.

Consequently, the first addition unit 540 may add sound signals of the left surround (SL) channel and sound signals of the right surround (SR) channel to output the added sound signals using the left surround speaker. Also, the second addition unit 550 may add sound signals of the right surround (SR) channel and sound signals of the right back (BR) channel to output the added sound signals using the right surround speaker.

Also, the 5.1 channel sound signals may be played using a speaker of the 5.1 channel as they are. Consequently, the 7.1 channel sound signals may be down-mixed into the 5.1 channel sound signals to be played using the 5.1 channel speaker systems.

Figure 6:
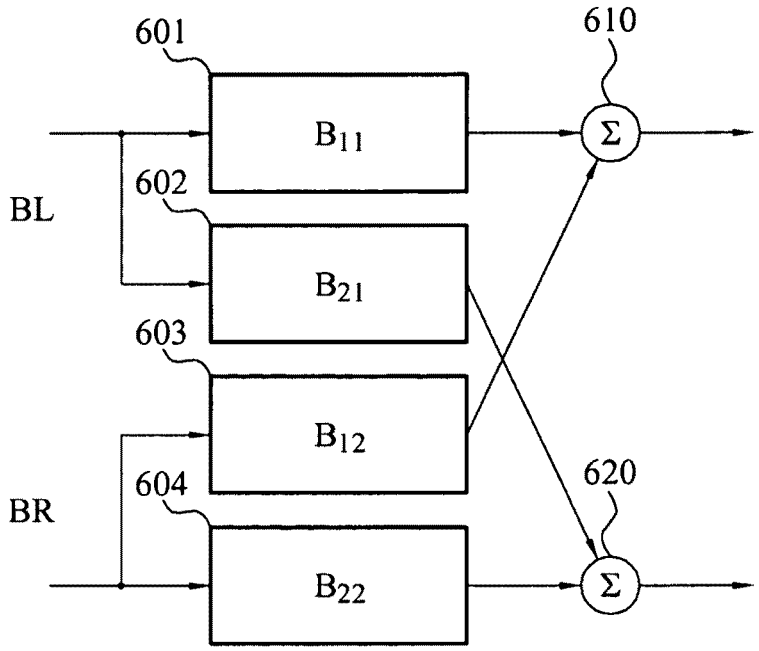
FIG. 6 is a diagram illustrating a binaural synthesizing unit of FIG. 5, in detail.

FIG. 6 is a diagram illustrating a binaural synthesizing unit 533 of FIG. 5, in detail.

The binaural synthesizing unit 533 of FIG. 5 may include a first convolution unit 601, a second convolution unit 602, a third convolution unit 603, a fourth convolution unit 604, a first addition unit 610, and a second addition unit 620.

As described above, an acoustic transfer function between a sound source and an eardrum may be referred to as a Head Related Transfer Function (HRTF). The HRTF may include a time difference and a level difference between two ears, information concerning a pinna of outer ears, spatial characteristics where sounds are generated, and the like.

In particular, the HRTF includes information about the pinna that may decisively influence upper and lower sound orientations. However, since a modeling with respect to a complex-shaped pinna may be difficult to be performed, the HRTF may be measured using a dummy head.

The back surround speaker may be generally positioned at an angle of about 135 to 150 degrees. Accordingly, the HRTF may be measured at the angle of about 135 to 150 degrees in left/right hand sides, respectively, from a front side to enable a virtual speaker to be localized at the angle of about 135 to 150 degrees.

In this instance, it is assumed that HRTFs corresponding to left/right ears of the dummy head from a sound source positioned at the angle of about 135 to 150 degrees in the left hand side are B11 and B21, respectively, and HRTFs corresponding to left/right ears of the dummy head from a sound source positioned at the angle of about 135 to 150 degrees in the right hand side are B12 and B22, respectively.

As illustrated in FIG. 6, the first convolution 601 may convolute left back channel signals (BL) and the HRTF B11, the second convolution 602 may convolute the left back channel signals (BL) and the HRTF B21, the third convolution 603 may convolute right back channel signals (BR) and the HRTF B12, and the fourth convolution unit 604 may convolute the right back channel signals (BR) and the HRTF B22.

The first addition unit 610 may add a first convolution value and a third convolution value to generate a first virtual left channel signal, and the second addition unit 620 may add a second convolution value and a fourth convolution value to generate a second virtual right channel signal. Consequently, signals passing through the HRTF with respect to a left ear and signals passing through the HRTF with respect to a right ear are added up to be outputted using a left virtual speaker, and the signals passing through the HRTF with respect to the right ear and the signals passing through the HRTF with respect to the left ear are added up to be outputted using a right virtual speaker.

Accordingly, when hearing binaural synthesized two channel-signals using a headphone, an audience may feel like being positioned at the angle of about 135 to 150 degrees in the left/right sides.

Figure 7:
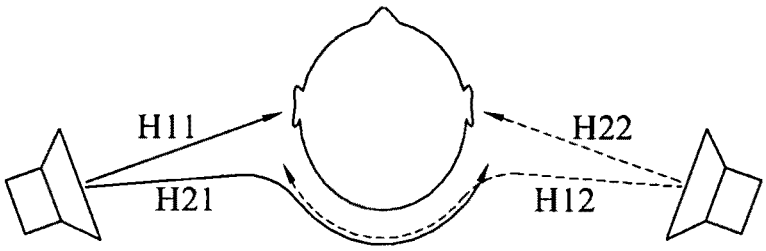
FIG. 7 is a conceptual diagram illustrating a cross-talk canceller of FIG. 5.

FIG. 7 is a conceptual diagram illustrating a cross-talk canceller 536 of FIG. 5.

In an embodiment, the binaural synthesis scheme may show superior performance when playing sounds using a headphone. When playing sounds using two speakers, crosstalk may occur between the two speakers and two ears as illustrated in FIG. 7, thereby reducing a sound localization characteristic.

That is, left-channel sound signals may need to be heard only by a left ear, and right-channel sound signals may need to be heard only by a right ear. However, due to the crosstalk occurring between the two channels, the left-channel sound signals may be heard by the right ear and the right-channel sound signals may be heard by the left ear, and thereby the localization feeling performance may be reduced. Accordingly, to prevent sound signals played in a left speaker (or right speaker) from being heard by a right ear (or left ear) of an audience, the crosstalk may need to be removed.

Referring to FIG. 7, since a surround speaker is generally disposed at an angle of about 90 to 110 degrees in left/right sides from a front side with respect to an audience, an HRTF of about 90 to 110 degrees may be first measured to design the crosstalk canceller.

It is assumed that HRTFs corresponding to left/right ears of the dummy head from a speaker positioned at the angle of about 90 to 110 degrees in the left side are H11 and H21, respectively, and HRTFs corresponding to left/right ears of the dummy head from a speaker positioned at the angle of about 90 to 110 degrees in the right side are H12 and H22, respectively. Using these HRTFs H11, H12, H21, and H22, a matrix C(z) for a crosstalk cancel may be designed to be an inverse matrix of an HRTF matrix, as shown in the following Equation 10.

$$\begin{bmatrix} C_{11}(z) & C_{12}(z) \\ C_{21}(z) & C_{22}(z) \end{bmatrix} = \begin{bmatrix} H_{11}(z) & H_{12}(z) \\ H_{21}(z) & H_{22}(z) \end{bmatrix}^{-1}. \quad \text{[Equation 10]}$$

Figure 8:
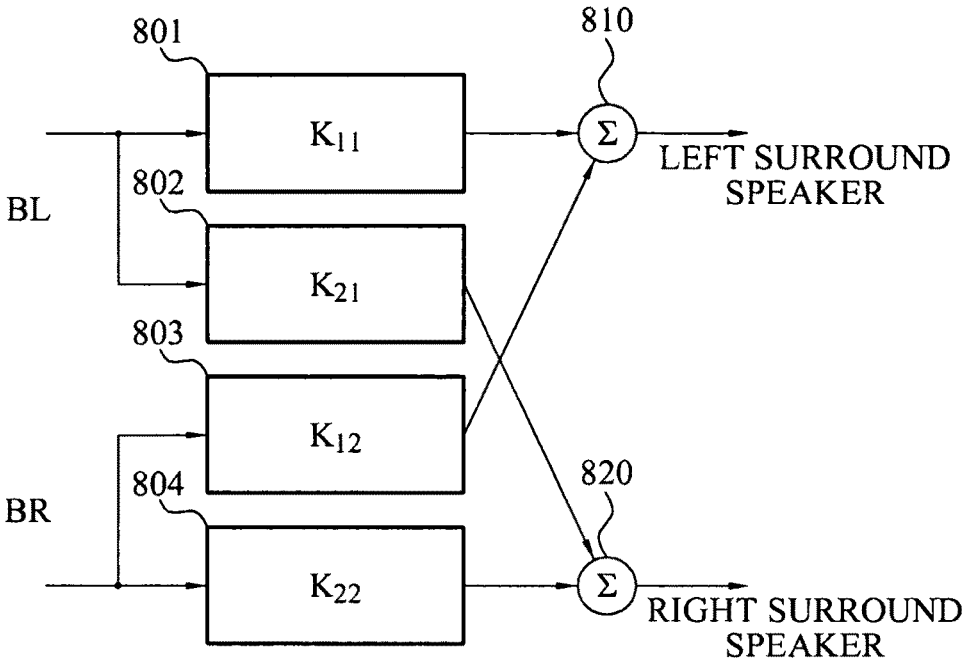
FIG. 8 is a diagram illustrating a back-surround filter of FIG. 5, in detail.

FIG. 8 is a diagram illustrating a back-surround filter 530 of FIG. 5, in detail.

The binaural synthesizing unit 533 may be a filter matrix type enabling a virtual speaker to be localized in positions of the left back speaker and the right back speaker, and the crosstalk canceller 536 may be a filter matrix type removing crosstalk occurring between two speakers and two ears.

Accordingly, the back surround filter matrix K(z) may multiply a matrix for synthesizing binaural sounds and a matrix for canceling the crosstalk, as shown in the following Equation 11.

$$\begin{bmatrix} K_{11}(z) & K_{12}(z) \\ K_{21}(z) & K_{22}(z) \end{bmatrix} = \begin{bmatrix} C_{11}(z) & C_{12}(z) \\ C_{21}(z) & C_{22}(z) \end{bmatrix} \begin{bmatrix} B_{11}(z) & B_{12}(z) \\ B_{21}(z) & B_{22}(z) \end{bmatrix}. \quad \text{[Equation 11]}$$

As illustrated in FIG. 8, when left back channel signals (BL) and right back channel signals (BR) are convoluted with the back surround filter matrix K(z), signals of two channels may be obtained. That is, as illustrated in FIG. 8, a first convolution unit 801 may convolute the left back channel signals (BL) and a filter coefficient K11, a second convolution unit 802 may convolute the left back channel signals (BL) and a filter coefficient K21, a third convolution unit 803 may convolute the right back channel signals (BR) and a filter coefficient K12, and a fourth convolution unit 804 may convolute the right back channel signals (BR) and a filter coefficient K22.

A first addition unit 810 may add a first convolution value and a second convolution value to generate a virtual left back sound source, and a second addition unit 820 may add a second convolution value and a fourth convolution value to generate a virtual back sound source.

When sound signals of these two channel are played using a left surround speaker and a right surround speaker, respectively, it may have the same effect as that obtained when sound signals of the left back channel sounds and sound signals of the right back channel are heard from a rear side of an audience (at the angle of about 135 to 150 degrees).

Figure 9:
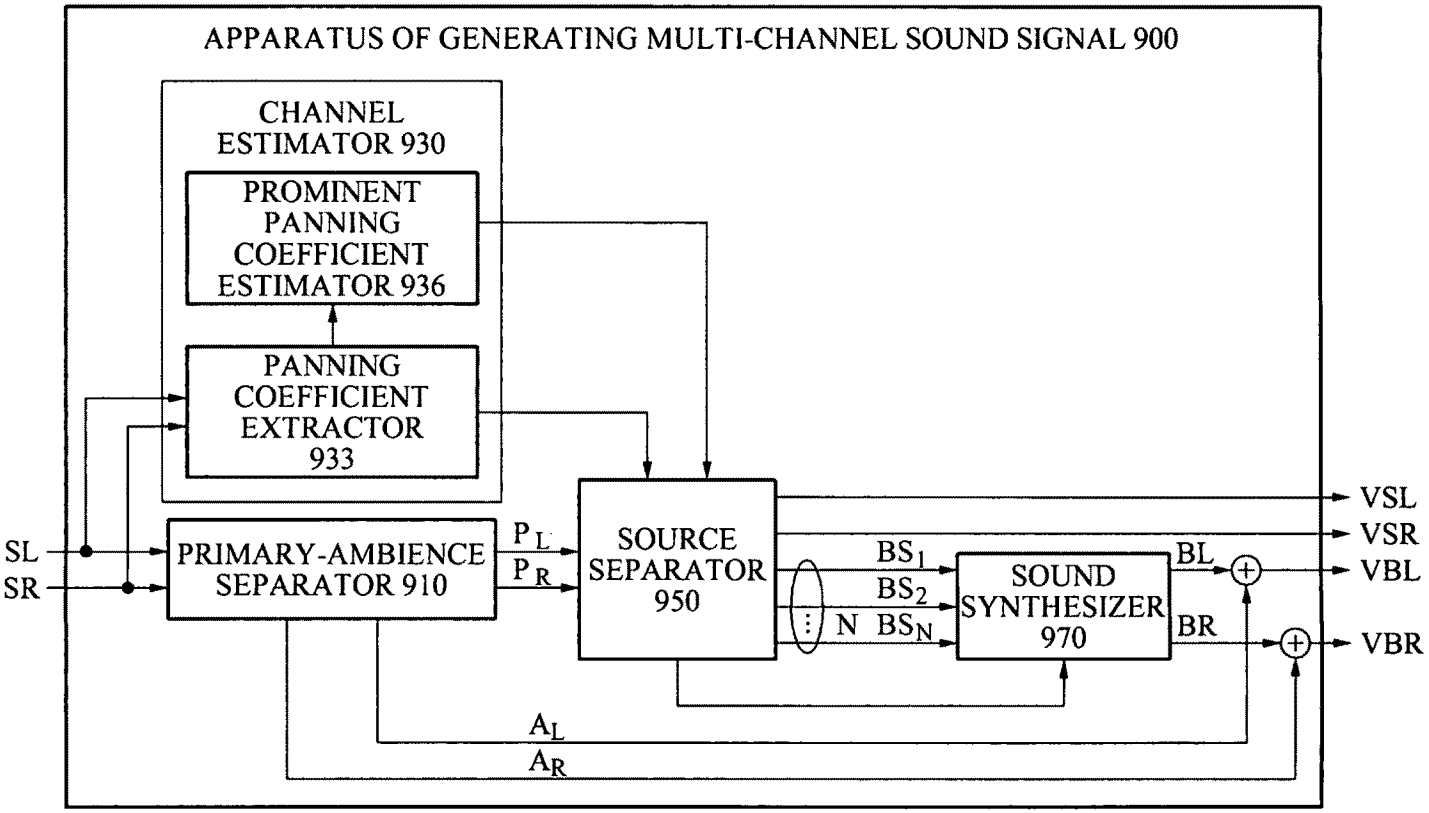
FIG. 9 is a diagram illustrating an apparatus of generating a multi-channel sound signal according to another embodiment.

FIG. 9 is a diagram illustrating an apparatus 900 of generating a multi-channel sound signal according to another embodiment.

Referring to FIG. 9, the apparatus 900 according to an embodiment includes a primary-ambience separator 910, a channel estimator 930, a source separator 950, and a sound synthesizer 970.

The primary-ambience separator 910 may separate source sound signals SL and SR into primary signals PL and PR and ambience signals AL and AR.

In general, as a method of applying up-mixing in a frequency domain, a method in which information enabling to determine a region being mainly comprised of ambience components in a time-frequency domain is extracted, and a weighting value with respect to a nonlinear mapping function is applied using the extracted information to thereby synthesize the ambience signals may be used.

As a method of extracting ambience index information, an inter-channel coherence measurement scheme may be used. An ambience extraction scheme may be an up-mixing scheme performed by approaching a short-time Fourier transformation (STFT)-region.

A method of separating a virtual channel with respect to stereo signals will be herein described in detail.

Using the up-mixing scheme performed such that a degree of amplitude-panning between two source signals is extracted to extract signals before being mixed from signals mixed in both channels, a center channel may be generated.

Using inter-coherence between two source signals, a degree in which ambience signals are panned may be extracted to obtain a nonlinear weighting value with respect to each time-frequency domain signal. Thereafter, using the obtained nonlinear weighting value, rear side channels may be generated by the up-mixing scheme of generating the ambience signals.

The channel estimator 930 may determine a number (N) of sound signals based on the source sound signals SL and SR separated in the primary-ambience separator 910. In this instance, the sound signals may be generated such that primary signals are separated.

Here, the number (N) of sound signals may indicate a number of sound sources being comprised of sound signals based on mixing characteristics and spatial characteristics of the sound signals.

The number (N) of sound signals determined in the channel estimator 930 may be determined based on a number of sound sources mixed in the source sound signals.

Also, the channel estimator 930 may extract a prominent panning coefficient from a panning coefficient extracted using a panning coefficient extractor 933, which extracts a panning coefficient from source sound signals and an energy histogram, and may include a prominent panning coefficient estimator 936, which determines a number of prominent panning coefficients as N.

The prominent panning coefficient estimator 936 may determine a region where an energy distribution is significantly shown, using the energy histogram with respect to the panning coefficients provided from the panning coefficient extractor 933, thereby determining a panning coefficient of a sound signal source and the number (N) of prominent panning coefficients.

Here, the determined number (N) of prominent panning coefficients may indicate a number of channels that source sound signals may be desirably separated into, and may be provided to the source separator 950 to be used for optimally separating the sound signal source.

The source separator 950 may separate the primary signals PL and PR provided from the primary-ambience separator 910 into N sound signals.

A channel separation performed using the channel estimator 930 and the source separator 950 will be herein further described.

The source sound signals SL and SR inputted to the primary-ambience separator 910 may be simultaneously inputted to the panning coefficient extractor 933 of the channel estimator 930, and the panning coefficient extractor 933 may extract a current panning coefficient with respect to the inputted source sound signals SL and SR.

In this instance, the panning coefficient extracted by the panning coefficient extractor 933 may be provided to the prominent panning coefficient estimator 936, and the prominent panning coefficient estimator 936 may determine the region where the energy distribution is significantly shown using the energy histogram with respect to the provided panning coefficients, thereby determining the prominent panning coefficient and the number (N) of prominent panning coefficients (a number of channels or sounds to be separated).

The current panning coefficient extracted from the panning coefficient extractor 933, and the prominent panning coefficient and the number (N) of prominent panning coefficients determined by the prominent panning coefficient estimator 936 may be provided to the source separator 950.

The source separator 950 may separate inputted source sound signals based on a degree in which the inputted source sound signals are panned, using the current panning coefficient based on the prominent panning coefficient and the number (N) of prominent panning coefficients.

A method of separating channel signals using a panning coefficient for each frame signal in the apparatus of generating the multi-channel sound signal according to an embodiment will be described in detail with reference to the descriptions of FIG. 8.

The sound signals SL and SR inputted into the channel estimator 930 and the primary-ambience separator 910 may separate the primary signals PL and PR and the ambience signals AL and AR to improve a degree of de-correlation between the separated channel signals (e.g., between SL and BL and between SR and BR), and ambience components provided from the primary-ambience separator 910 may be added in a back surround speaker after performing a channel separation with respect to primary components inputted from the primary-ambience separator 910 to the source separator 950, so that a more widened space perception may be obtained, and the degree of de-correlation may be improved, thereby intuitively increasing a distance from a sound source and a width of the sound source.

The sound synthesizer 970 may synthesize N sounds signals to be M sound signals, and may synthesize at least one of the M sound signals with ambience signals.

Figure 10:
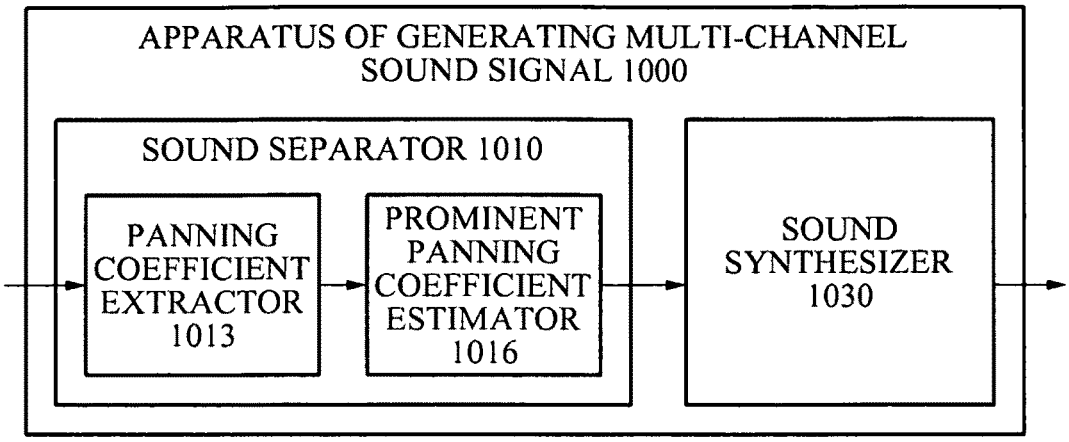
FIG. 10 is a block diagram illustrating an apparatus of generating a multi-channel sound signal according to another embodiment.

FIG. 10 is a block diagram illustrating an apparatus 1000 of generating a multi-channel sound signal according to another embodiment.

Referring to FIG. 10, the apparatus 1000 according to another embodiment includes a sound separator 1010 and a sound synthesizer 1030.

When receiving multi-channel sound signals, the sound separator 1010 may separate the multi-channel sound signals into N sound signals using location information of source signals being mixed in the multi-channel sound signals.

Here, the sound separator 1010 may determine a number (N) of sound signals using the location information of the source signals being mixed in the multi-channel sound signals. In this instance, the sound signals may be generated such that the multi-channel sound signals are separated.

Also, the location information may be a panning coefficient extracted from the multi-channel sound signals.

Also, the sound separator 1010 may extract a prominent panning coefficient from a panning coefficient extracted using a panning coefficient extractor 1013 and an energy histogram, and may include a prominent panning coefficient estimator 1016 determining a number of prominent panning coefficients as N. In this instance, the panning coefficient extractor 1013 may extract the panning coefficient from the multi-channel sound signals.

The sound synthesizer 1030 may synthesize N sound signals to be M sound signals.

In the method of separating sound signals, the sound signals may be re-synthesized according to a number of actual speakers after separating the sound signals. Otherwise, the sound signals may be separated by a number of actual output speakers and a re-panning may be performed on the separated sound signals based on a position of the actual output speaker. Here, the re-panning may indicate an amplitude-pan scheme that may implement a direction feeling when playing sound signals by inserting a single sound source into both left/right channels to have different magnitudes of the sound source.

In a method, according to an embodiment, of synthesizing the sound signals to obtain a same number of channel signals as a number of real output speakers in the re-panning, the degree of de-correlation of separated sound channel sources may be reduced, and when the sound channel sources are down-mixed using a virtual space mapping to be played, interferences between identical sound sources may increase, thereby reducing a sound localization characteristics.

In the apparatus according to an embodiment, since the apparatus is based on an up-mixing system and since the up-mixing is performed to obtain a virtual channel mapping, up-mixed channel sources may not need to be re-synthesized according to a predetermined number of speakers. In addition, the apparatus according to an embodiment may determine a number of sound channels intended to be separated, by predicting a number of mixed sound sources using a method of chronologically obtaining characteristics between target sound sources to be channel-separated, and separate sound sources into variable channel number per processing unit, using the determined number of sound channels.

In this instance, the separated sound channels may perform a down-mixing process and an interference canceling process, without performing a re-synthesizing process that may reduce the degree of de-correlation between channels due to a limitation in a number of output speakers, thereby generating the multi-channel sound signals. Here, the down-mixing process may enable sound sources to be localized in a virtual space depending on a number of the separated variable channel sound sources and information about the sound sources.

Figure 11:
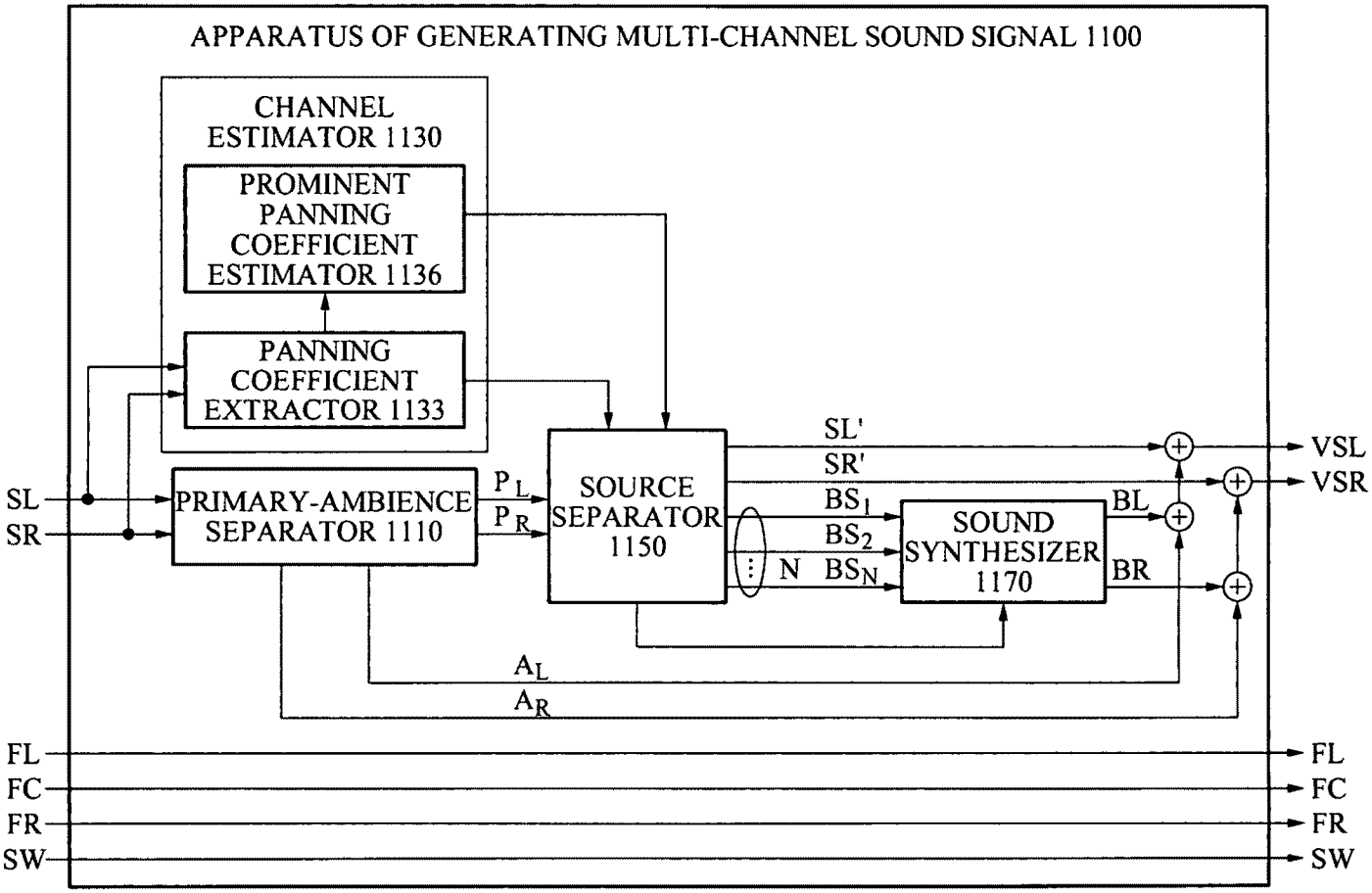
FIG. 11 is a diagram illustrating an apparatus of generating a multi-channel sound signal according to another embodiment.

FIG. 11 is a diagram illustrating an apparatus 1100 of generating a multi-channel sound signal according to another embodiment.

Referring to FIG. 11, in order to combine the virtual channel separation, the virtual channel mapping, and the interference removal processes of the apparatus to play virtual multi-channel sound signals in the 5.1 channel source and the speaker system, the apparatus 1100 according to another embodiment includes a primary-ambience separator 1110, a channel estimator 1130, a source separator 1150, and a sound synthesizer 1170.

The primary-ambience separator 1110 may generate primary signals PL and PR and ambience signals AL and AR from left surround (SL) signals and right surround (SR) signals of 5.1 surround sound signals.

The channel estimator 1130 may determine a number (N) of sound signals to be generated from the primary signals PL and PR. In this instance, the channel estimator 1130 may determine the number (N) of sound signals, based on mixing characteristics or spatial characteristics of the left surround (SL) signals and right surround (SR) signals.

Also, the channel estimator 1130 may extract a prominent panning coefficient from a panning coefficient extracted using a panning coefficient extractor 1133 and an energy histogram, and may include a prominent panning coefficient estimator 1136 determining a number of prominent panning coefficients as N. In this instance, the panning coefficient extractor 1133 may extract the panning coefficient from the left surround (SL) signals and the right surround (SR) signals.

The source separator 1150 may receive the primary signals PL and PR from the primary-ambience separator 1110, and generate N sound sources.

A channel separation process by the channel estimator 1130 and the source separator 1150 may be performed in the same manner as that by the channel estimator 930 and the source separator 950 of FIG. 9.

The sound synthesizer 1170 may synthesize the N sound signals generated in the source separator 1150 to generate left back (BL) signals and right back (BR) signals, synthesize the left back (BL) signals and left ambience signals (AL), and synthesize the right back (BR) signals and right ambience signals (AR).

An embodiment of the sound synthesizer 1170 may further refer to descriptions of FIGS. 5 to 8.

As described above, according to embodiments, sound signal-like sounds may be obtained even using a system having a small number of speakers.

Also, according to embodiments, interferences between sound sources may be reduced to improve a sound localization characteristic.

The above described methods may be recorded, stored, or fixed in one or more computer-readable storage media that includes program instructions to be implemented by a computer to cause a processor to execute or perform the program instructions. The media may also include, alone or in combination with the program instructions, data files, data structures, and the like. The media and program instructions may be those specially designed and constructed, or they may be of the kind well-known and available to those having skill in the computer software arts.

Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions.

Examples of program instructions include both machine code, such as produced by a compiler, and files containing higher level code that may be executed by the computer using an interpreter. The described hardware devices may be configured to act as one or more software modules in order to perform the operations and methods described above, or vice versa. The instructions may be executed on any processor, general purpose computer, or special purpose computer including an apparatus of generating a multi-channel sound signal and the software modules may be controlled by any processor.

As described above, according to exemplary embodiments, in a method of separating sound signals, the sound signals may be re-synthesized according to a number of actual speakers, after separating the sound signals, to enhance realism of 3D sound.

Although a few exemplary embodiments have been shown and described, it would be appreciated by those skilled in the art that changes may be made in these exemplary embodiments without departing from the principles and spirit of the disclosure, the scope of which is defined in the claims and their equivalents.

What is claimed is:

1. An apparatus of processing a multi-channel signal, the apparatus comprising:

a sound separator to receive a multi-channel signal and to determine a first number (N) of channel signals based on at least one of a mixing characteristic and a spatial characteristic of the multi-channel signal, and to separate the multi-channel signal into the first number (N) of channel signals, the first number (N) of channel signals being generated such that the multi-channel signal is separated; and a sound synthesizer to synthesize the first number (N) of channel signals to be a second number (M) of channel signals, wherein the sound separator comprises:

a panning coefficient extractor to extract a panning coefficient from the multi-channel signal; and a prominent panning coefficient estimator to extract a prominent panning coefficient from the extracted panning coefficient using an energy histogram, and to determine a number of the prominent panning coefficients as N.

2. The apparatus of claim 1, wherein N varies over time.

3. The apparatus of claim 1, wherein the sound synthesizer includes a binaural synthesizer to generate the M channel signals using a Head Related Transfer Function (HRTF) measured at a predetermined position.

4. The apparatus of claim 3, further comprising a crosstalk canceller, wherein the binaural synthesizing unit and the crosstalk canceller generate the M channel signals based on the measured HRTF and cancel crosstalk of a virtual sound source.

5. The apparatus of claim 4, wherein the output of the crosstalk canceller and the binaural synthesizing unit are convoluted to obtain the virtual sound sources.

6. An apparatus of processing a multi-channel signal, the apparatus comprising:

a primary-ambience separator to separate a source signal into a primary signal and an ambience signal;

a channel estimator to determine a first number (N) of channel signals based on at least one of a mixing characteristic and a spatial characteristic of the source signal, the first number (N) of channel signals being generated such that the primary signal is separated;

a source separator to separate the primary signal into the first number (N) of channel signals; and a sound synthesizer to synthesize the first number (N) of channel signals into a second number (M) of channel signals, and to synthesize at least one of the M channel signals and the ambience signal, wherein the channel estimator comprises:

a panning coefficient extractor to extract a panning coefficient from the source signal; and a prominent panning coefficient estimator to extract a prominent panning coefficient from the extracted panning coefficient using an energy histogram, and to determine a number of the prominent panning coefficients as N.

7. The apparatus of claim 6, wherein N is determined depending on a number of sources mixed in the source signal.

8. An apparatus of processing a multi-channel signal, the apparatus comprising:

a sound separator to receive a multi-channel signal and to determine a first number (N) of channel signals based on at least one of a mixing characteristic and a spatial characteristic of the multi-channel signal, and to separate the multi-channel signal into the first number (N) of channel signals; and a sound synthesizer to synthesize the first number N of channel signals separated using the prominent panning coefficient into a second number (M) of channel signals, wherein the sound separator comprises:

a panning coefficient extractor to extract a panning coefficient from the multi-channel signal; and a prominent panning coefficient estimator to extract the prominent panning coefficient from the extracted panning coefficient using an energy histogram, and to determine a number of the prominent panning coefficients as N.

9. The apparatus of claim 8, wherein the sound separator determines the first number (N) of the channel signals using position information of a source signal mixed in the multi-channel signal, the channel signals being generated such that the multi-channel signal is separated.

10. The apparatus of claim 9, wherein the position information of the source signal mixed in the multi-channel signal is the panning coefficient extracted from the multi-channel signal.

11. An apparatus of processing a multi-channel signal, the apparatus comprising:

a primary-ambience separator to generate, from a left surround signal (SL) and a right surround signal (SR) of a 5.1 surround signal, a left primary signal (PL), a right primary signal (PR), a left ambience signal (AL), and a right ambience signal (AR);

a channel estimator to determine a first number (N) of channel signals being generated from the left primary signal (PL) and the right primary signal (PR) based on at least one of a mixing characteristic and a spatial characteristic of the left surround signal (SL) and the right surround signal (SR);

a source separator to receive the left primary signal (PL) and the right primary signal (PR) and to generate the received signals as the first number (N) of channel signals; and a sound synthesizer to synthesize the first number (N) of channel signals to generate a left back signal (BL) and a right back signal (BR), to synthesize the left back signal (BL) and the left ambience signal (AL), and to synthesize the right back signal (BR) and the right ambience signal (AR), wherein the channel estimator comprises:

a panning coefficient extractor to extract a panning coefficient from the left surround signal (SL) and the right surround signal (SR); and a prominent panning coefficient estimator to extract a prominent panning coefficient from the extracted panning coefficient using an energy histogram, and to determine a number of the prominent panning coefficients as N.

* * * * *